United States Patent [19]

Kitawaki et al.

[11] 4,081,605

[45] Mar. 28, 1978

[54] SPEECH SIGNAL FUNDAMENTAL PERIOD EXTRACTOR

[75] Inventors: Nobuhiko Kitawaki, Kodaira; Shinichiro Hashimoto, Koganei, both of Japan

[73] Assignee: Nippon Telegraph and Telephone Public Corporation, Tokyo, Japan

[21] Appl. No.: 715,399

[22] Filed: Aug. 18, 1976

[30] Foreign Application Priority Data

Aug. 27, 1975 Japan ..... 50-102473

[51] Int. Cl.[2] ..... G10L 1/00

[52] U.S. Cl. ..... 179/1 SC

[58] Field of Search ..... 179/1 SC, 1 SA

[56] References Cited

U.S. PATENT DOCUMENTS

| | | | |
|---|---|---|---|
| 3,662,115 | 5/1972 | Saito | 179/1 SC |
| 3,740,476 | 6/1973 | Atal | 179/1 SC |
| 3,975,587 | 8/1976 | Dunn | 179/1 SA |

OTHER PUBLICATIONS

Comer; D. et al., "Speech Recognition Voicing Detector," IBM Tech. Bulletin, vol. 6, No. 10, Mar. 1964.

Harper; T., "Friction-Voicing Separator," IBM Tech. Bulletin, vol. 4, No. 9, Feb. 1962.

*Primary Examiner*—Kathleen H. Claffy

*Assistant Examiner*—E. S. Kemeny

[57] ABSTRACT

A speech signal fundamental period extractor which receives a residual value signal from a speech analyzer, such as one using autocorrelators. The residual value signal is first passed through a filter to remove the high-frequency components. Then the signal is quantized to obtain low-bit quantization of the residual value. The output from the quantizer is then sent to an autocorrelator to obtain the correlation coefficient and the fundamental period is extracted by selecting the position of a maximum correlation coefficient. This provides more accurate results and permits the use of low-speed elements and a reduction of components.

9 Claims, 13 Drawing Figures

RESIDUAL VALUE TERMINAL
6
LOW PASS FILTER
19
QUANTIZER
20
8
21
QUANTIZER OUTPUT TERMINAL
SPEECH SIGNAL FUNDAMENTAL PERIOD EXTRACTOR
RESIDUAL VALUE BUFFER MEMORY
14
RESIDUAL VALUE BUFFER. MEMORY
22
AUTO-CORRELA-TOR
15
17
MAXIMUM-VALUE SELECTOR
16
8
FUNDAMENTAL PERIOD OF SPEECH OUTPUT
9
18
MAXIMUM VALUE OF A CORRELATION OUTPUT

| BIT | 1 | 2 | 3 | 4 | 5 | 6 | 7 | 8 | 9 | 10 | 11 | 12 |
|---|---|---|---|---|---|---|---|---|---|---|---|---|
| PRIOR ART | 12.4 | 12.2 | 11.7 | 10.4 | 9.7 | 9.6 | 9.6 | 8.9 | 8.7 | 8.7 | 8.7 | 8.7 |
| THIS INVENTION | 0.8 | 0.8 | 0.8 | 0.9 | 0.9 | 1.1 | 0.8 | 0.8 | 0.7 | 0.7 | 0.7 | 0.7 |

SPEECH SIGNAL FUNDAMENTAL PERIOD EXTRACTOR

BACKGROUND OF THE INVENTION

FIELD OF THE INVENTION

This invention relates to a speech signal fundamental period extractor which permits the economical construction of a speech analyzer.

DESCRIPTION OF THE PRIOR ART

For increased efficiency of communication between a person and a band compression data transmission system or an information processor, a speech analysis-synthesis method has been developed and is now in practical use in new data communication services, such as seat reservation by telephone, or information services at airports and railway stations, etc.

A speech wave is a sound wave which is emitted from the lips or the nose when a vocal cord vibration wave (a voiced source,) or a noise wave (an unvoiced source) due to a turbulent flow produced by the constriction of the vocal tract, is applied to the vocal tract. In the case of speech synthesis, a voiced sound source is obtained by driving an impulse generator, and an unvoiced sound source is obtained by driving a white noise generator. The vocal tract and a radiator are respectively formed by an electric circuit equivalent to its transfer function, and a speaker.

Speech analysis includes a sound source analysis for quantitatively clarifying the property of the sound source which drives the vocal tract, and a spectrum analysis for clarifying the frequency spectrum at certain time intervals (10 to 30 msec.) which the transfer function of the vocal tract has. The sound source analysis requires quantitative extraction of three factors, that is, a signal of distinguishing between an impulse train drive (a voiced sound) and a noise drive (an unvoiced sound) the pitch of the impulse train (the voiced sound), and the amplitude of the impulse train (the voiced sound) or the noise (the unvoiced sound). However, these factors vary at an appreciably high speed, and hence are most difficult to analyze with accuracy. The fundamental period of speech, even in the case of a voiced sound period, is especially difficult to accurately extract because it is not strictly periodic and changes every moment in accordance with the intonation of speech and is susceptible to perturbation by the mechanism of voice production and the influence of the transfer characteristic of the vocal tract.

Heretofore, there have been proposed various speech analysis-synthesis systems such as a short-time spectrum analysis using a band-pass filter bank, a formant frequency locus using a zero cross counting method, and so on. Of these systems, a partial autocorrelation (PARCOR) system is known as one of the most excellent systems for data compression rate, the quality of synthesized speech, and automatic extraction of speech characteristic parameters.

As referred to above, in speech analysis and synthesis, the speech fundamental period is one of the three important sound source parameters. With the PARCOR system for extracting this parameter, a residual value of the output from a PARCOR coefficient analyzer is applied to an autocorrelator to extract an autocorrelation coefficient. A delay time T, corresponding to the peak value of this coefficient, is regarded as the fundamental period of speech.

With other speech analysis-synthesis systems, the speech wave is applied to a filter having an inverse characteristic of a spectrum approximating the speech wave, and the output wave from the filter is used as a residual value to obtain the fundamental period of speech by the same operation as mentioned above.

However, since the residual value is a signal indicative of only a minute construction of the speech spectrum and has an impulse-like waveform, the abovesaid extracting methods have the defect that a double or half period of the fundamental period is likely to be extracted erroneously unless the sampling period is selected to be very short. Further, if the residual value is represented by low bits, the above tendency is especially marked and low bits quantization of the residual value is difficult.

Accordingly, the autocorrelator should to employ a very high-speed element in order to carry out a high-precision operation in a short time. This introduces a great difficulty in the realization of the device.

In the invention of U.S. Pat. No. 3,740,476, a residual value derived from a low-pass filter is subjected to half wave rectification to leave the positive component alone, and its peak in a certain period is selected by a peak detector. Then waveform processing such as the elimination of components lower than a threshold level is achieved, thus extracting the fundamental period of speech.

In the magazine IEEE AU-20-5, 1972 there is set forth a fundamental period extracting method in which a residual value is subjected to 1/5 down sampling and then applied to an inverse filter to calculate an autocorrelation to thereby reduce the amount of calculation. After the autocorrelation is obtained, lowering of the resolving power due to the down sampling is interpolated to extract the fundamental period of speech. With this method, however, it is necessary to perform the same operation as the PARCOR coefficient extraction separately thereof.

Further, in the magazine J.A.S.A. Vol. 56, 1974, there is disclosed a method wherein the extraction of the fundamental period by the autocorrelation method is effected in a manner suitable for hardware. In this case, however, since a speech waveform itself is an object to be processed, a center clipping function is required for removing the formant construction of speech.

The PARCOR speech analysis-synthesis system to which this invention is applied is employed in a band compression data transmission system in which, on the transmitting side, speech is analyzed into parameters effectively representing the speech and, on the receiving side, the original speech is synthesized based on these parameters.

In recent years, digital signal processing techniques of this kind have rapidly been developed and now put to practical use. However, the processing is so complicated that the apparatus therefor is very expensive. Especially, the throughput of a sound source analyzing unit is, for example, larger by an order of magnitude, as compared with the throughput of a spectrum analyzing unit. Accordingly, reduction of the cost by the employment of LSI would be impossible even if further development of IC techniques should be expected.

SUMMARY OF THE INVENTION

One object of this invention is to provide an economical speech analyzer.

Another object of this invention is to provide a speech signal fundamental period extractor in which unnecessary high-frequency components contained in a residual value are eliminated by a low-pass filter to definitely detect the maximum value of its autocorrelation coefficient, to thereby extract the fundamental period of speech accurately and stably.

Another object of this invention is to provide a speech signal fundamental period extractor in which the residual value from a low-pass filter is represented by low bits to permit simplification of an arithmetic circuit and to reduce the capacity of a memory for storing the residual value, and the speed required of elements is reduced to produce an economical effect.

Another object of this invention is to provide a speech signal fundamental period extractor in which the accuracy of extraction of the fundamental period of speech is improved to provide for enhanced quality of synthesized speech in the band compression data transmission of speech, or in an audio response apparatus.

Still another object of this invention is to provide a speech signal fundamental period extractor in which only the polarity of the residual value from a low-pass filter is utilized, to thereby simplify the construction of an arithmetic circuit, and to reduce the capacity of a memory for storing the residual value and to reduce the speed of the elements to thereby produce an economical effect.

In accordance with one aspect of this invention, unnecessary components are removed from the residual value of a speech wave applied to a filter having an inverse characteristic of the spectrum approximately a speech signal, and the fundamental period of the speech is extracted from the correlation coefficeint of the residual value.

In accordance with another aspect of this invention, the unnecessary components contained in the residual value are removed therefrom and the fundamental period of speech is extracted from the correlation coefficient of a signal when the residual value is quantized by low bits.

In accordance with another aspect of this invention, the unnecessary components contained in the residual value are removed therefrom and then the fundamental period of speech is extracted from the correlation coefficient of only the polarity of the residual value.

DESCRIPTION OF THE PREFERRED EMBODIMENTS

An output signal resulting from the PARCOR analysis of a speech signal is a residual value. A method of extracting the fundamental period of speech from the cporrelation coefficient of the residual value requires methods of the highest extraction accuracy.

Figure 1:
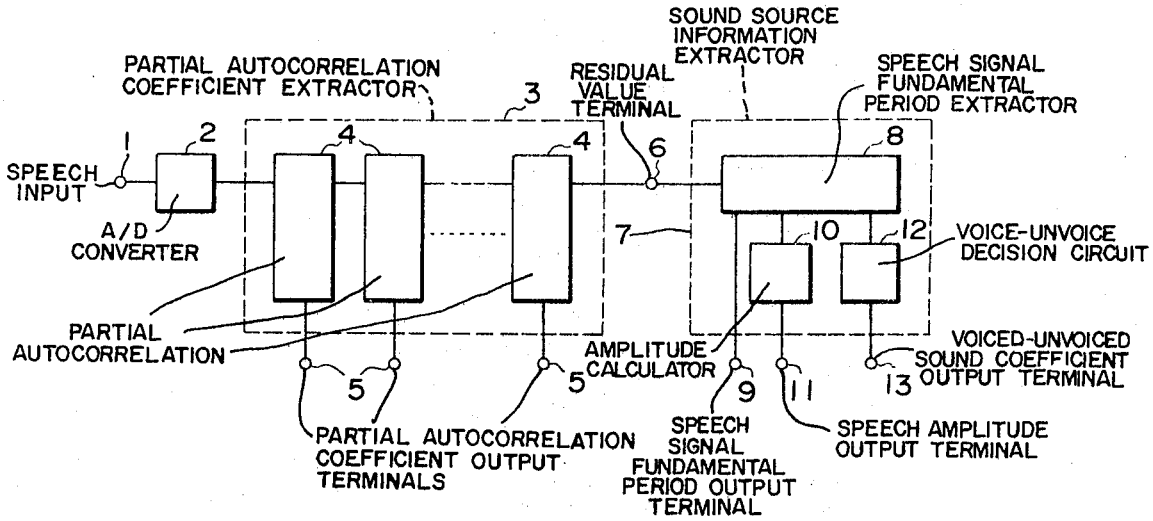
FIG. 1 is a block diagram showing a speech analyzer of the partial autocorrelation (PARCOR) system.

FIG. 1 shows in block form a fundamental extractor employing the PARCOR system.

In FIG. 1, reference numeral 1 indicates a speech input terminal; 2 designates an A–D converter; 3 identifies a partial autocorrelation coefficiency extractor, 4 denotes a partial autocorrelator; 5 represents a partial autocorrelation coefficient output terminal; 6 shows a residual value terminal; 7 refers to a sound source information extractor; 8 indicates a speech signal fundamental period extractor; 9 designates a speech signal fundamental period output terminal; 10 identifies a speech signal amplitude calculator; 11 denotes a speech signal amplitude output terminal; 12 represents a voiced-unvoiced sound decision circuit; and 13 shows a voiced sound and an unvoiced sound coefficient output terminal.

A speech signal $x(t)$ applied to the input terminal 1 is converted by the A–D converter 2 into a digital signal having a sampling frequency of 8 KHz and quantized by a sign bit plus 11 bits. The digital signal is applied to the partial autocorrelation coefficient extractor 3.

The partial autocorrelation coefficient extractor 3 comprises about 10 stages of partial autocorrelators 4 which are connected in cascade. In each partial autocorrelator 4, the correlation between closely adjacent sampled values of the speech signal is provided as a partial autocorrelation coefficient $k_i$ at the output terminal 5. The correlation components thus extracted between the closely adjacent sampled values are removed from the speech signal, which is applied to the next stage.

As such processing is repeated, the correlations between adjacent sampled values of the speech signal are all removed as partial autocorrelation coefficients and, at the output terminal 6 of the last partial autocorrelator stage, there are provided only correlation coefficients between relatively remotely spaced waveforms concerning the sound source information of the speech. The output from the partial autocorrelation coefficient extractor, derived at the residual value terminal 6 will hereinafter be referred to as a residual value $\epsilon(t)$.

Figure 2:
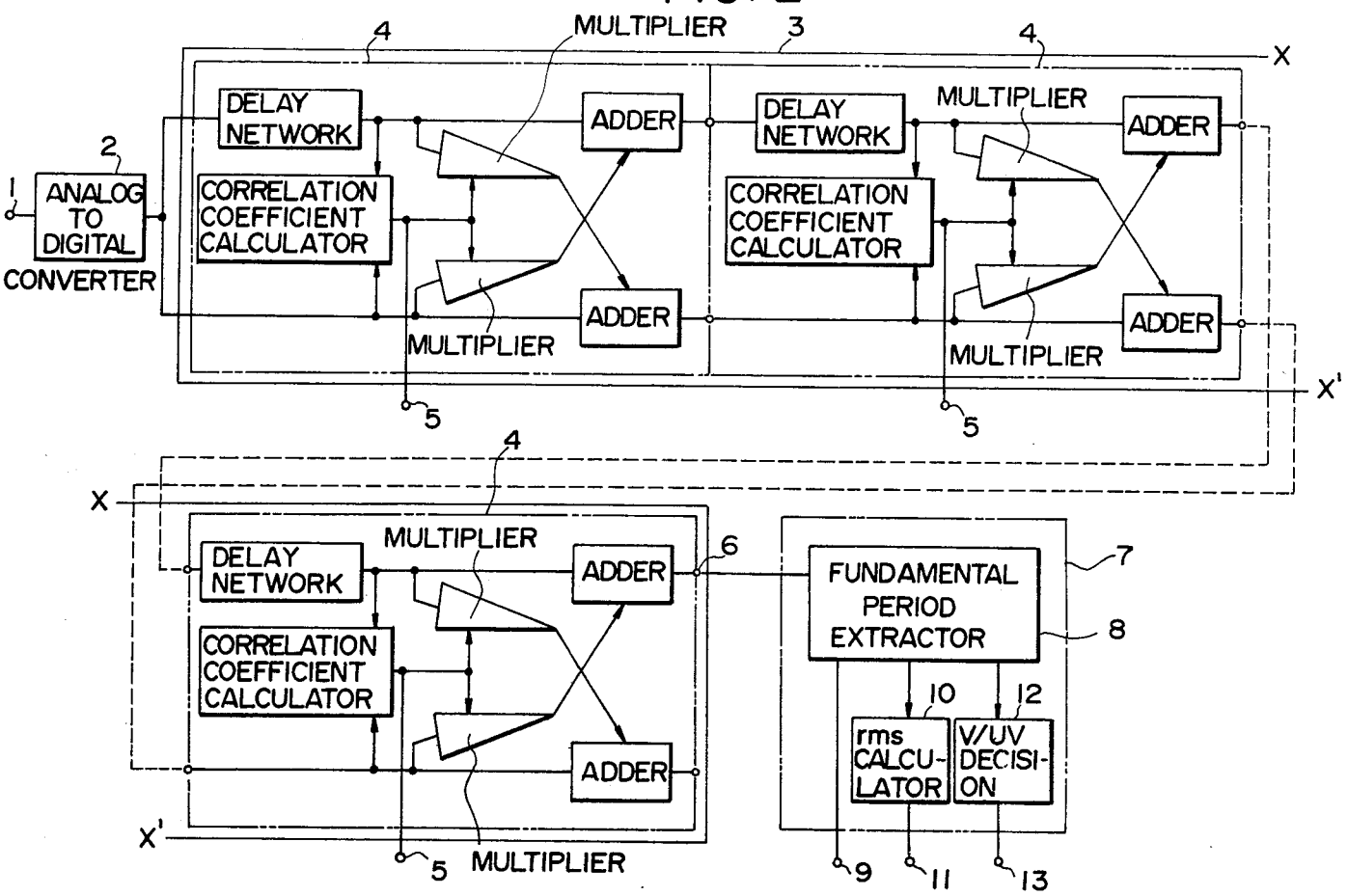
FIG. 2 is a detailed block diagram of the speech analyzer shown in FIG. 1.

The partial autocorrelation coefficient extractor 3 employed in FIG. 1 is shown in detail in FIG. 2. The correlation coefficient calculator used in FIG. 2 is shown in detail in FIG. 3.

The digital signal is applied to the partial autocorrelation coefficient extractor 3 from the A–D converter 2 and, in the first partial autocorrelator 4, the digital signal is divided into two portions, one portion being applied to a correlation coefficient calculator through a delay network and the other being applied to the calculator directly to obtain correlations between immediately adjacent sampled values of the input digital signal to provide a primary correlation coefficient at the terminal 5. After the correlation coefficient is multiplied by the digital signal applied to a multiplier through the delay network and the digital signal directly applied to another multiplier, respectively, the multiplied outputs are each supplied to an adder to obtain the difference between the multiplied output and the other digital signal, and which difference is applied to the next partial autocorrelator 4. In the next partial autocorrelator 4, correlations between every other sample value of the input digital signal are obtained to produce a secondary correlation coefficient at the terminal 5.

Figure 3:
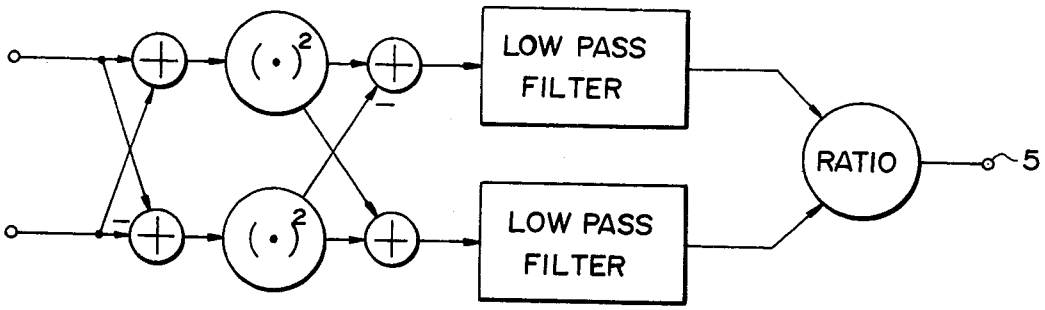
FIG. 3 is a diagram showing in detail a correlation coefficient calculator employed in FIG. 2.

As shown in FIG. 3, in the correlation coefficient calculator, the sum of and the difference between the two input digital signals are obtained and respectively squared. Then, their sum and difference are obtained again and respectively applied to low-pass filters to determine mean values of these inputs for a certain period of time. The outputs from the low-pass filters are divided to obtain a ratio therebetween, producing a correlation coefficient at the terminal 5.

By such proceedings at each partial autocorrelator stage 4, the quantity corresponding to the correlation coefficient between sampled values closer than those at the stage is eliminated at the immediately preceding stage. Accordingly, the spectrum of the input digital signal becomes gradually flatter and, after about ten stages, it is almost flat. Using the residual value at the terminal 6, the fundamental period $\tau$ is obtained by the speech signal fundamental period extractor 8.

Similarly, an output wave derived from a filter having an inverse characteristic of a spectrum approximately a sppech wave is generally called a residual value. The following description will be given in connection with the method employing the partial autocorrelation coefficient.

The speech amplitude L is extracted by the speech amplitude calculator 10 and voiced and unvoiced sound coefficients V and UV are extracted by the voiced-unvoiced sound decision circuit 12. These outputs are derived at terminals 11 and 13, respectively.

The speech characteristic parameters $k_i$ ($i=1$ to 10), T, V, UV and L thus extracted are quantized and transmitted with a frame period from about 5 to 15 msec. On the receiving side, the original speech can be reconstructed by a partial autocorrelation speech synthesizer which is controlled by the abovesaid parameters.

Figure 4:
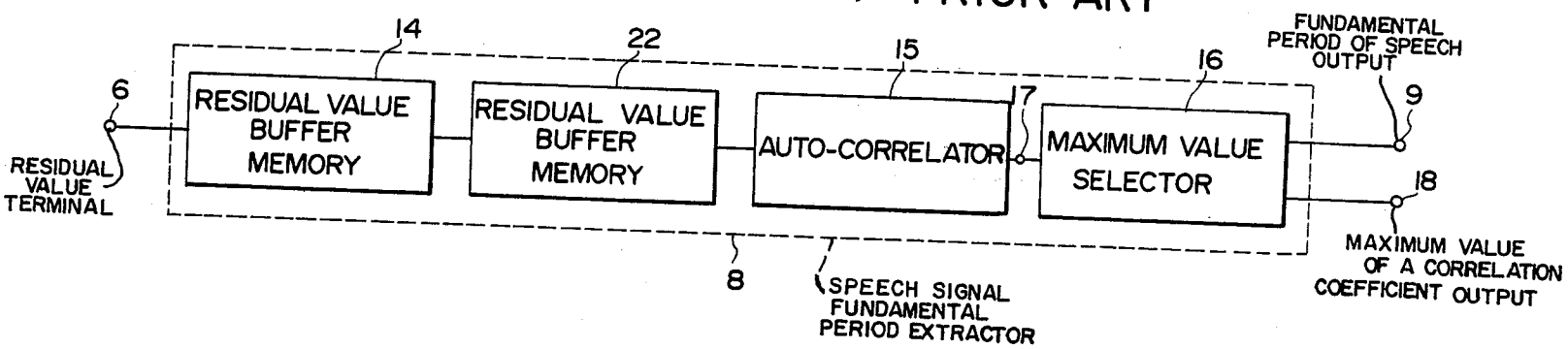
FIG. 4 PRIOR ART
FIG. 4 is a block diagram illustrating a conventional speech signal fundamental period extractor.

FIG. 4 shows in detail the construction of an example of a conventional speech signal fundamental period extractor 8. In FIG. 4, reference numeral 14 indicates a memory; 22 designates a memory similar thereto; 15 denotes an autocorrelator; 16 identifies a maximum value selector; 17 represents an output terminal for the correlatin coefficient of the residual value; and 18 shows a maximum value output terminal. The residual value is stored in the memory 14. Next, a short period (about 20 to 40 msec.) twice or three times the fundamental period of the speech is extracted and sampled values of one frame are stored in the memory 22. The correlation coefficient of the residual value is calculated by the autocorrelator 15, since the fundamental period appears as a periodic repetition of its maximum value. Next, a sweep range (2 to 20 msec.) of the fundamental period is provided with a maximum value of the correlation coefficient of the residual value is detected by the maximum value selector 16. The position of the maximum value thus detected is taken as the output as the fundamental period of the speech at the terminal 9 and its value is outputted at the terminal 18.

Now, a brief explanation will be made of the method as employed above, of extracting the fundamental period from the autocorrelation of the periodic signal. The autocorrelation coefficient $R(n)$ of a discrete signal $\epsilon(t)$ is expressed by the following equation:

$$R(n) = \lim_{N\to\infty} \frac{1}{N} \sum_{i=1}^{N} \epsilon_i \cdot \epsilon_{i+n} \qquad \text{(i)}$$

If the discrete signal is, for example, a sine wave, the signal $\epsilon(t)$ and the autocorrelation coefficient $R(n)$ are given by the following equations (ii) and (iii):

$$\epsilon(t) = \sum_{m=1}^{N} a_m \cos(m\omega_0 t + \theta_m) \qquad \text{(ii)}$$

$$R(n) = \frac{1}{2} \sum_{m=1}^{N} a_m^2 \cos m\omega_0 n \qquad \text{(iii)}$$

As is apparent from the equation (iii), phase information of each frequency component is lost and maximum values of the respective components are completely in agreement with each other at a period which is an integral multiple n of the fundamental period, so that the value of the autocorrelation coefficient $R(n)$ also exhibits its maximum value but then becomes smaller at other periods. Accordingly, the fundamental period can be obtained by detecting the maximum value.

In practice, where the signal period changes at every moment and the change with time is an important parameter, as is the case with speech, the infinite integral in the equation (i) is insignificant, so that use is made of a short-time autocorrelation coefficient of the following equation (iv) or a value normalized by the signal energy given by the following equation (v).

$$R_N(n) = \frac{1}{N} \sum_{i=1}^{N} \epsilon_i \cdot \epsilon_{i+1} \qquad \text{(iv)}$$

$$\phi_N(n) = \frac{R_N(n)}{R_N(0)} \qquad \text{(v)}$$

Figure 5:
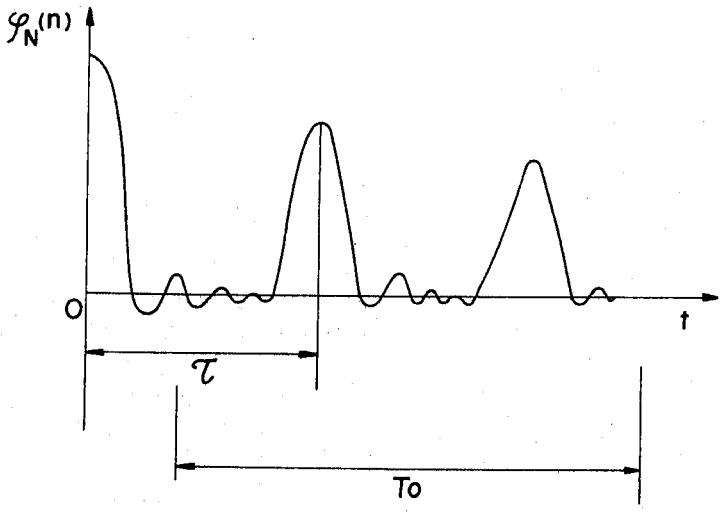
FIG. 5 is a graph showing a correlation waveform.

FIG. 5 is a schematic diagram showing a correlation waveform. The fundamental period $\tau$ in FIG. 5 bears the relationship of the following generation (vi) to a speech sampling period $\tau s$:

$$\tau\ n \cdot \tau s \ldots \qquad \text{(vi)}$$

In FIG. 5, reference character $T_0$ indicates a sweep range of the maximum value of each frequency component.

Thus, with the conventional system, the influence of the formant based on the transfer characteristic of the vocal tract is eliminated by the PARCOR analysis and the fundamental period is extracted with high accuracy. However, the operations therefor are complicated and the throughput is large, so that extremely high-speed elements are required for real time processing and this inevitably increases the cost of the analyzer. That is, the operational precision for representing the residual value requires about 12 bits. For example, in the case where a short period of 20 msec. is cut out of a speech signal and converted into a digital signal represented by 12 bits and having a sampling frequency of 8 KHz, then as the autocorrelation coefficient (n=0 to 100) of the equation (iv) is calculated, it is necessary to calculate the product (about 12 bits × 12 bits) 16000 times and the sum (24 bits + 24 bits) 16000 times within as short a period of time as 10 msec. The construction of the fundamental period extractor required to perform such operations is possible only with very high-speed elements such as Schottky TTLs.

Figure 6:
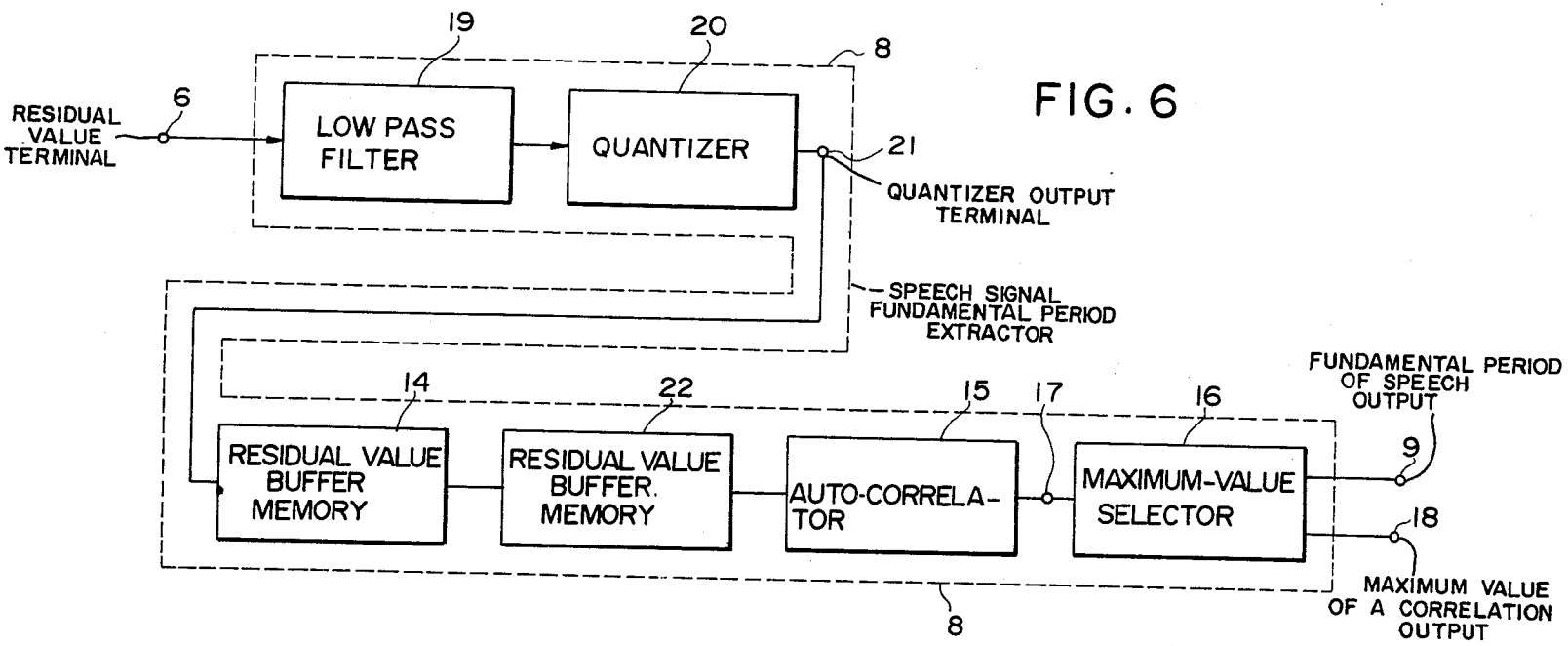
FIG. 6 is a block diagram showing the speech signal fundamental period extractor of this invention.

This invention is intended to overcome such a defect of the prior art. One embodiment of this invention is illustrated in block form in FIG. 6. In FIG. 6, reference numeral 6 indicates a residual value input terminal; 19 designates a low-pass filter; 20 identifies a quantizer; 21 denotes a quantizer output terminal; 14 represents a memory; 22 shows another memory; 15 refers to an autocorrelator; 17 indicates an autocorrelator output terminal; 16 designates a maximum value selector; 9 identifies an output terminal for the fundamental period of speech; and 18 denotes an output terminal for a maximum value of a correlation coefficient.

In the extraction of the fundamental period of speech, a period of 20 to 40 msec., which is twice or three times the fundamental period, is usually selected to be analyzed and the fundamental period extraction takes place, with the period of analysis being shifted in the range from 5 to 15 msec. Now, a description will be given with regard to the case of extracting the fundamental period from a residual value converted into a digital signal which has a sampling frequency of 8 KHz and is quantized by a sign bit plus 11 bits. Assume that the length of the frame to be analyzed by one analysis is 20 msec. in time and 160 in sampled value and that the fundamental period is extracted, with the frame being shifted by 10 msec. and 80 sampled values.

The residual value applied to the input terminal 6 at time intervals of 125 μsec. is applied to the low-pass filter 19 to remove unnecessary high-frequency components and is then applied to the quantizer 20. In the quantizer 20, the signal is subjected to peak clipping, quantization or the like for representation by low bits. The quantized signal, corresponding to 80 sampled values, is stored in the memory 14. The memory 14 takes the form of a shift register or the like and its capacity is 1 bit × 80 words in this example. When the 80 sampled values have been written in the memory 14, the content of the memory 14 is transferred to the next memory 22 before the arrival of the next subsequent sampled values to the memory 14, that is, before the lapse of 125 μsec., and storing of the new sampled values in the memory 14 starts. The memory 22 has a capacity of storing the sampled values of one frame, which capacity is 1 bit × 160 words in this example. The sampled values of the immediately preceding frame and the 80 sampled values newly transferred from the memory 14, make a total of 160 sampled values which form one frame in the memory 22. The memory 22 is formed with a shift register or the like. Next, in the autocorrelator 14, autocorrelation coefficients to about 100th order lag is calculated. In the maximum value selector 16, the fundamental period of speech is detected as the position of a maximum autocorrelation coefficient in the sweep range ($T_0$) from 20th to 100th order lags and derived at the fundamental period output terminal 9. The maximum value of the autocorrelation coefficient is also provided at the output terminal 18.

Since the speech fundamental period extractor of this invention as described above is constructed so that the unnecessary high-frequency components contained in the residual value are cut off by a low-pass filter, it is possible to clearly detect the maximum value of the correlation coefficient of the residual value. Accordingly, the residual value derived from the low-pass filter is represented by a low bit, utilizing the above effect, whereby the scale of operation can be reduced remarkably.

In the case of calculating the equation (iv) under the same conditions as in the aforesaid example, the prior art method requires 16,000 multiplications of 12 bits × 12 bits and 16,000 additions of 24 bits + 24 bits in 10 msec. but the method of this invention requires only 16,000 additions of 1 bit, and hence is very economical. Further, the conventional method requires the memory 14 to have a memory capacity of 12 bits × 80 words and the memory 22 to have a memory capacity of 12 bits × 160 words. With the method of this invention, however, the memory capacities required of these memories are 1 bit × 80 words and 1 bit × 160 words, respectively. This permits of remarkable economication of the circuit construction. The fundamental period extractor of the prior art system requires about 10,000 gates but the extractor of this invention requires only about 2,000, which is 1/5 that of the prior art extractor. Accordingly, the speed required of the elements is also about 1/5 that of the prior art extractor, so that although the operation region of the conventional apparatus is the region of the Schottky TTL, that of the apparatus of this invention may be a MOS region. As a result of this, the apparatus of this invention can be formed with LSIs.

Figures 7, 14:
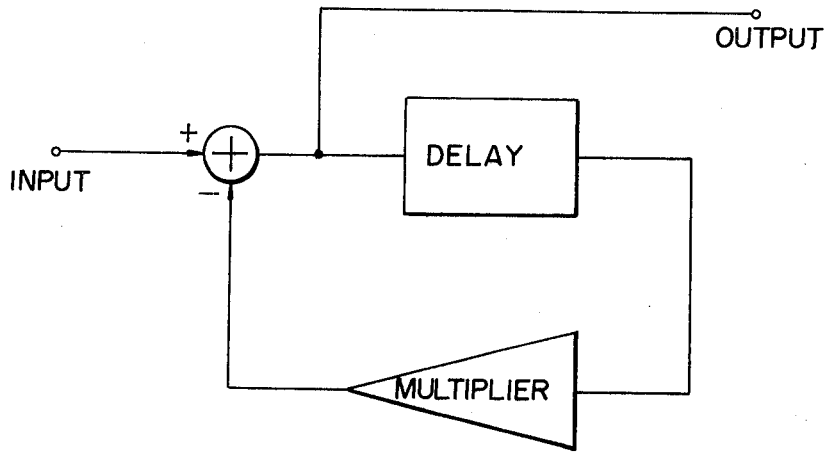
FIG. 7 is a diagram illustrating one example of a digital filter used in FIG. 6.
FIG. 14 is a diagram for the comparison of this invention with the prior art system, showing bits representing a residual waveform and errors in the fundamental period.

The low-pass filter 19 used in FIG. 6 may be a digital filter such, for example, as shown in FIG. 7.

The digital filter is hardware which comprises, as fundamental circuit components, a digital adder, a multiplier and a delay element for performing the operation given by the following constant-coefficient linear differential equation:

$$y(nT) = \sum_{\mu=0}^{N} a_\mu x\{(n-\mu)T\} - \sum_{\nu=1}^{N} b_\nu y\{(n-\nu)T\} \quad \text{(vii)}$$

where $n(nT)$ and $y(nT)$ are input and output signal series and $a\nu$ and $b\nu$ are real numbers.

FIG. 7 illustrates a first order recursive filter. When a quantity $x$ is applied from an input terminal (INPUT), the input and the output from a multiplier are subtracted from each other by an adder to provide the resulting difference output at an output terminal (OUTPUT). At the same time, the difference output is applied to a delay circuit and the multiplier to provide an output ax, which is applied to the adder for subtraction with the next input. Thereafter, the above operation is repeated. When the above filter is regarded as a linear system, the response decreases with the coefficient a of the multiplier and finally becomes zero in the range of $|a|<1$. In the case of a non-linear system, the response value is converged to zero only in the range of $|a|<0.5$ and, with the other values, the system is unstable.

In the present invention, however, the type of such a digital filter is not so important and the filter of such a simple construction as depicted in FIG. 7 will suffice so long as its cut-off frequency is in the range from 500 to 1,000 Hz.

Figure 8:
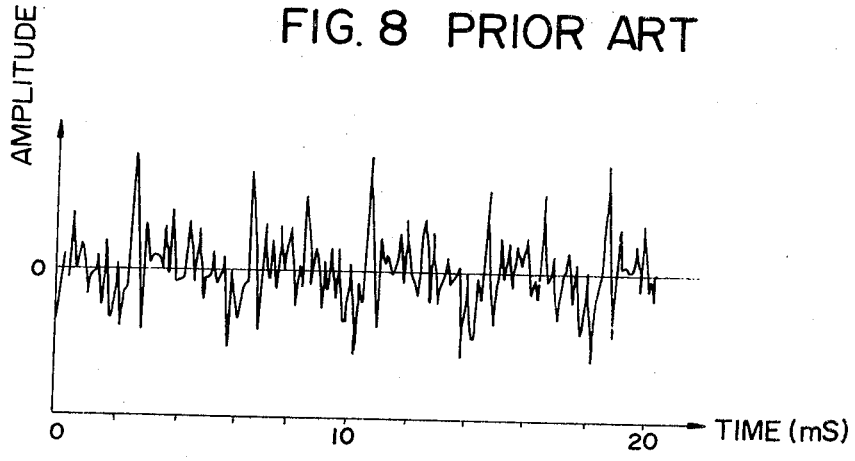
FIG. 8 PRIOR ART
FIG. 8 is a waveform diagram showing a residual value in a short period in the conventional apparatus.
Figure 9:
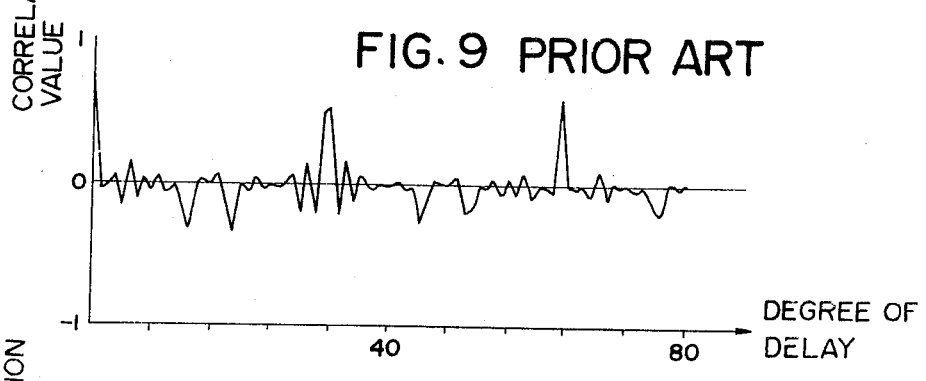
FIG. 9 PRIOR ART
FIG. 9 is a waveform diagram showing a correlation coefficient when the waveform of the residual value in the prior art apparatus was quantized by 12 bits.
Figure 10:
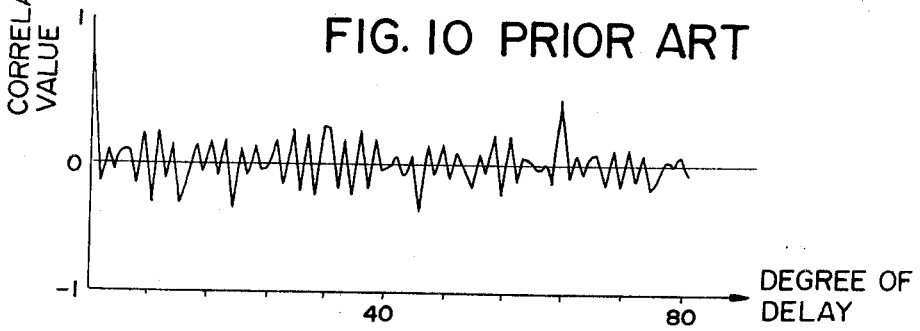
FIG. 10 PRIOR ART
FIG. 10 is a waveform diagram showing a correlation coefficient when the residual value in the prior art apparatus was quantized by one bit (expressed by the polarity alone)
Figure 11:
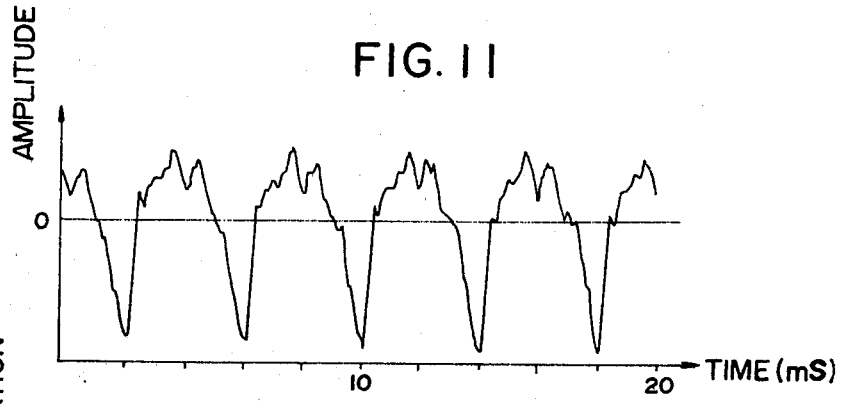
FIG. 11 is a waveform diagram showing a residual value obtained from a low-pass filter in this invention.
Figure 12:
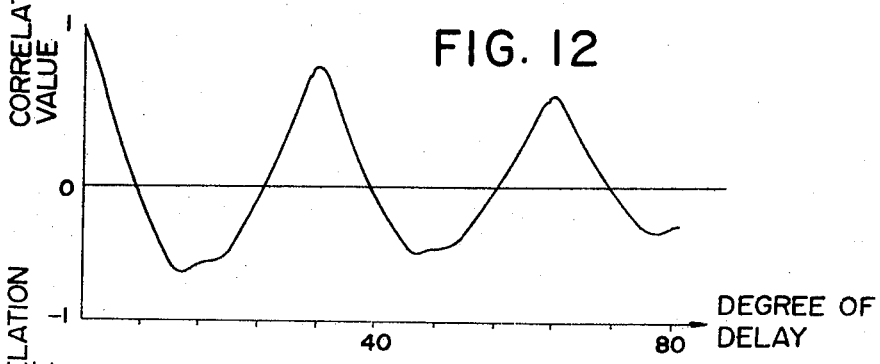
FIG. 12 is a waveform diagram showing a correlation coefficient when the residual value obtained from the low-pass filter was quantized by 12 bits, in accordance with this invention.
Figure 13:
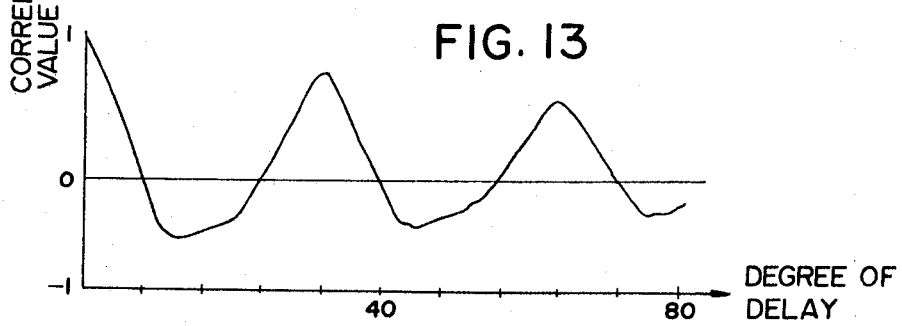
FIG. 13 is a waveform diagram showing a correlation coefficient of only the polarity of the residual value obtained from the low-pass filter (quantized by one bit)

Referring now to FIGS. 8 to 14, the method of this invention will be compared with the prior art method. FIG. 8 shows a waveform of a residual value having a length of 20 msec. and FIGS. 9 and 10 respectively show waveforms of correlation coefficients according to the prior art system when the residual value waveform of FIG. 8 was quantized by 12 bits and 1 bit. FIG. 11 shows a waveform obtained when the residual signal was applied to a digital filter having a cut-off frequency of 500 Hz and FIGS. 12 and 13 shows waveforms of correlation coefficients according to this invention when the waveform of FIG. 11 was quantized by 12 bits and 1 bit (the polarity alone), respectively. Accordingly, FIGS. 8 and 11, 9 and 12 and 10 and 13 respectively show the waveforms corresponding to each other.

With the conventional system, when the waveform is represented by 12 bits as depicted in FIG. 9, maximum values of the correlation coefficient can be recognized. However, when the residual signal is represented by a low bit (1 bit) as shown in FIG. 10, a second maximum value, in this example, cannot be recognized, resulting in an erroneous extraction of a period twice the fundamental period.

On the other hand, in this invention, a quantized noise also has the same period as a periodic signal, so that in the case of extracting the fundamental period alone, the quantization of the signal does not matter essentially. Accordingly, as is evident from FIG. 13, it is possible to extract the fundamental period with sufficient accuracy from the correlation coefficient only of the polarity of the residual value after applied to the low-pass filter.

In order to obtain the operational precision necessary for the quantizer (a D—D converter) employed in FIG. 6, the fundamental period of speech was obtained by the apparatus of this invention from voices of three women reading a writing for about 3.5 sec. In FIG. 14, there are shown such the errors in the fundamental period extraction in a voiced sound period, using the operational precision 12 to 1 bit, and normalized (in %) by the number of all frames in the voiced sound period. FIG. 14 indicates that the error was about 10 (%) in the conventional fundamental period extractor but less than 1 (%) in the apparatus of this invention. Even in case of the correlation by 1-bit quantization (only the polarity), sufficient precision can be obtained.

The foregoing description has been made in connection with the speech analysis system in the case of representing a speech waveform using a partial autocorrelation coefficient as a parameter. However, it is evident that the invention is also applicable to a residual value of a speech wave derived from a filter having an inverse characteristic of a spectrum approximating the speech wave.

As has been described above, in the present invention, a maximum value of the correlation coefficient of a residual value can be clearly detected by applying the residual value to a low-pass filter, so that the fundamental period of speech can be extracted accurately and stably. Especially, since the correlation of only the polarity of a signal suffices for the extraction, it is sufficient to perform additive operations only. In the conventional system there is required multiplying and additive operations. Accordingly, the circuit construction of the fundamental period extractor of this invention is greatly simplified, as compared with conventional apparatus. Further, accuracy of the fundamental period of speech can be improved as described above, so that the quality of the synthesized speech can be remarkably enhanced in the band compression transmission of speech or in an audio response apparatus.

It will be apparent that many modifications and variations may be effected without departing from the scope of the novel concepts of this invention.

What is claimed is:

1. A speech signal fundamental period extractor comprising:

means for removing unnecesary high-frequency components from a residual value of a speech wave;

means for quantizing the output signal from said high-frequency component removing means to obtain only the low-bit quantization thereof:

an autocorrelator means supplied with the low-bit quantization of the output signal from said quantizing means for calculating a correlation coefficient thereof; and means for obtaining the fundamental period of speech by selecting the position of a maximum correlation coefficient from the output of said autocorrelator.

2. The speech signal fundamental period extractor of claim 1 wherein said removing means comprises a filter means having an inverse characteristic of a spectrum approximating the speech signal.

3. The speech signal fundamental period extractor of claim 2 and further comprising buffer memory means interconnected between said quantizing means and said autocorrelator means.

4. The speech signal fundamental period extractor of claim 3, wherein said filter means comprises a digital low-pass filter having a cut-off frequency of between 500 to 1000 Hz.

5. The speech signal fundamental period extractor according to claim 3 wherein the correlation coefficient calculated by said autocorrelator is an autocorrelation coefficient of a residual value obtained by a linear predictive analysis.

6. The speech signal fundamental period extractor as in claim 3 and further comprising analog to digital converter means for receiving a speech signal, a partial autocorrelation coefficient extractor receiving the output of said analog to digital converter and providing said residual value to said removing means.

7. The speech signal fundamental period extractor of claim 3 and wherein said filter means comprises a digital adder having two inputs and an output, said adder providing the difference of two signals applied to said inputs, a delay means coupled to the adder output, a multiplier means coupled between the delay means and one of the inputs of said adder, the other adder input serving as the filter input, and the adder output serving as the filter output.

8. A speech signal fundamental period extractor comprising:

a digital filter means having a cut-off frequency of between 500 and 1000 Hz for removing high-frequency components from a residual value of a speech wave applied thereto, said filter means having an inverse characteristic of a spectrum approximating the speech signal;

means for quantizing the output signal from said digital filter to obtain low-bit quantization thereof;

autocorrelator means for calculating an autocorrelation coefficient of the output signal from said quantizing means; and means for obtaining the fundamental period of speech by selecting the position of a maximum value of said autocorrelation coefficient.

9. The speech signal fundamental period extractor of claim 8 and further comprising buffer memories interconnected between said quantizer means and said autocorrelator means.

* * * * *

UNITED STATES PATENT AND TRADEMARK OFFICE

CERTIFICATE OF CORRECTION

PATENT NO. : 4,081,605

DATED : March 28, 1978

INVENTOR(S) : Nobuhiko Kitawaki, and Shinichiro Hashimoto

It is certified that error appears in the above-identified patent and that said Letters Patent are hereby corrected as shown below:

On the cover sheet, after line [30] correct the foreign application priority date to read as follows:

August 22, 1975

Signed and Sealed this

*Eighth* Day of *August 1978*

[SEAL]

*Attest:*

RUTH C. MASON
*Attesting Officer*

DONALD W. BANNER
*Commissioner of Patents and Trademarks*